US010357088B2

(12) United States Patent
Liu

(10) Patent No.: US 10,357,088 B2
(45) Date of Patent: Jul. 23, 2019

(54) ANTI-COLLISION CORNER ARMOR FOR LAPTOP BAG

(71) Applicant: Shenzhen Tomtoc Technology Co., Ltd., Shenzhen, Guangdong Province (CN)

(72) Inventor: Yubo Liu, Shenzhen (CN)

( * ) Notice: Subject to any disclaimer, the term of this patent is extended or adjusted under 35 U.S.C. 154(b) by 84 days.

(21) Appl. No.: 15/461,112

(22) Filed: Mar. 16, 2017

(65) Prior Publication Data

US 2018/0263348 A1 Sep. 20, 2018

(51) Int. Cl.
*A45C 11/00* (2006.01)
*A45C 13/36* (2006.01)

(52) U.S. Cl.
CPC ..... *A45C 11/00* (2013.01); *A45C 13/36* (2013.01); *A45C 2011/002* (2013.01); *A45C 2011/003* (2013.01)

(58) Field of Classification Search
USPC ..... 206/453, 591, 592, 593, 594, 523; 248/345.1
See application file for complete search history.

(56) References Cited

U.S. PATENT DOCUMENTS 1,865,485 A * 7/1932 Sas ..... A47G 1/10 206/453
3,047,142 A * 7/1962 Heffley ..... A47B 95/043 206/453
4,202,449 A * 5/1980 Bendt ..... B65D 81/054 206/453
4,241,832 A * 12/1980 Bliss ..... B65D 81/05 206/523
4,244,471 A * 1/1981 Plante ..... B65D 19/0018 206/386
4,877,673 A * 10/1989 Eckel ..... B65D 81/054 428/172
5,657,955 A * 8/1997 Adams ..... A47B 95/043 248/345.1
6,073,770 A * 6/2000 Park ..... A45C 13/02 206/320
6,082,543 A * 7/2000 Beliveau ..... B65D 81/022 206/523
6,899,946 B2 * 5/2005 Geary ..... B32B 27/08 206/449

(Continued)

*Primary Examiner* — Jacob K Ackun
(74) *Attorney, Agent, or Firm* — Novoclaims Patent Services LLC; Mei Lin Wong

(57) ABSTRACT

Disclosed is an anti-collision corner armor for a laptop bag, which comprises at least a corner armor internal body at a corner of the laptop bag, wherein the upper surfaces of the ends of the corner armor internal body extend outwards to form protruding parts, and the upper surface of the middle portion of the corner armor internal body extends inwards to form a groove part; under the effect of external force, the upper surface of the corner armor internal body can bend towards a laptop, the protruding parts act on the side edge of the laptop, and the groove part makes contact with a corner of the laptop. The anti-collision corner armor can effectively protect the laptop is arranged inside the laptop bag without affecting the appearance design of the laptop bag, and is low cost. Furthermore, the anti-collision corner armor has good compatibility and expandability with the laptop.

3 Claims, 3 Drawing Sheets

(56) References Cited

U.S. PATENT DOCUMENTS

| | | | | |
|---|---|---|---|---|
| 8,672,375 | B2 * | 3/2014 | Conrad | B66C 1/122 206/453 |
| 2001/0001445 | A1 * | 5/2001 | Gallien | B65D 81/054 206/453 |
| 2011/0215019 | A1 * | 9/2011 | Wu | B65D 81/02 206/523 |
| 2012/0118767 | A1 * | 5/2012 | Koett | B63B 35/7909 206/315.1 |
| 2015/0194993 | A1 * | 7/2015 | Sajady | G06F 1/1626 455/575.1 |

* cited by examiner

ANTI-COLLISION CORNER ARMOR FOR LAPTOP BAG

BACKGROUND OF THE INVENTION

1. Technical Field

The invention belongs to the technical field of bags, and relates to an accessory for a laptop bag, in particular to an anti-collision corner armor arranged inside a laptop bag to protect a laptop.

2. Description of Related Art

With the development of science and technology and the instant requirements of people for working and entertainment, the popularization rate of laptops has increased gradually. As bags for storing laptops, laptop bags enable people to carry laptops conveniently and can protect the laptops at the same time, and thus the laptops are prevented from being squeezed, collided with and damaged by external forces. At present, although laptop bags of various styles are sold on the market, the laptop bags still need to be improved in many aspects.

Firstly, existing laptop bags have the problem of poor protection performance. Most existing laptop bags on the market are mainly used for containing, namely the laptop bags are used for storing the laptops and still have design defects or disadvantages in the aspect of laptop protection. The laptop bags are mainly characterized in that except for the size and the shape of the laptop bags which are matched with those of the laptops, the laptop bags have no difference from bag products not specially used for storing laptops in the aspects of design and technique. The probability of damage to the four most-vulnerable corners of the laptops can be greatly increased through the design.

According to one kind of rare laptop bag sold on the market at present, devices used for protecting laptops are arranged outside of bag bodies, for example, rubber surrounding edges or corner armor is additionally arranged outside the laptop bag for enhancing the protection performance, and consequentially, the overall appearance design of the bag is affected or limited more or less.

According to another kind of non-adaptive and non-expandable laptop bag on the market, the laptop bags are designed according to the overall shape of the laptops, and integrally wrap the laptops in the form of injection models to protect the laptops, and the models are arranged inside the laptop bags. The laptop bags have the defects of being extremely poor in adaptability and expandability for laptops of different types, brands and styles, thereby being high in overall manufacturing cost.

BRIEF SUMMARY OF THE INVENTION

In conclusion, the existing laptop bags sold on the market mainly have the following technical problems that:

(1) Most bag products can adapt to laptops only by correcting the sizes of the main bags or auxiliary bags, the laptop bags have severe hidden dangers in the aspect of laptop protection, and particularly, the laptops cannot be effectively protected when the vulnerable parts such as the sharp corners of the laptops are collided with by great external force.

(2) For certain laptop bags, protection devices such as external protection sleeves and external protection corner armor pads are arranged outside the bag bodies, and consequentially, the design space, particularly the appearance design space, of the laptop bags serving as bag products is limited.

(3) The cost including the mold creating cost, new material investment cost, the mold updating cost for adapting to new products and the like of the laptop bags with extra protection design is increased.

For overcoming the technical defects, the invention provides an anti-collision corner armor for a laptop bag. Specifically, for solving the problems, the following technical scheme is adopted by the invention:

The anti-collision corner armor for the laptop bag at least comprises a corner armor internal body arranged at a corner of the laptop bag, wherein the upper surfaces of the ends of the corner armor internal body extend outwards to form protruding parts, and the upper surface of the middle portion of the corner armor internal body extends inwards to form a groove part; under the effect of external force, the upper surface of the corner armor internal body can bend towards a laptop, the protruding parts act on the side edge of the laptop, and the groove part makes contact with a corner of the laptop.

Furthermore, according to the anti-collision corner armor for the laptop bag, the corner armor internal body is provided with two protruding parts and one groove part, and the groove part is located between the two protruding parts.

Furthermore, according to the anti-collision corner armor for the laptop bag, the portions, not extending outwards, on the two sides of each protruding part form flat parts, each protruding part is connected with two flat parts, and the two sides of the groove part are each connected with one flat part.

Furthermore, according to the anti-collision corner armor for the laptop bag, the anti-collision corner armor further comprises a corner armor external body arranged at the corner of the laptop bag, and the upper surface of the corner armor external body is attached to the lower surface of the corner armor internal body.

As an optimization of the shape and structure of the corner armor external body, the upper surface of the middle portion of the corner armor external body extends inwards to form a bent concave part, and under the effect of external force, the bent concave part and the groove part bend and deform synchronously.

Furthermore, according to the anti-collision corner armor for the laptop bag, the anti-collision corner armor further comprises a corner armor sheet body arranged at the corner of the laptop bag, the lower surface of the corner armor sheet body is fixedly connected with the laptop bag, and the upper surface of the corner armor sheet body is attached to the lower surface of the corner armor external body.

Preferably, the groove part is provided with a plurality of grooves which are arranged at intervals, and the multiple grooves are in parallel.

Preferably, the corner armor internal body and the corner armor external body are both made of flexible materials, and the hardness of the material made into the corner armor external body is higher than that of the material made into the corner armor internal body.

As an optimization of the shape of the corner armor external body, the corner armor internal body is in a long strip shape.

In addition, the invention provides a laptop bag. The laptop bag is provided with the anti-collision corner armor for the laptop bag of the invention, and the anti-collision corner armor is arranged at the corner of the laptop bag.

Compared with the prior art, the anti-collision corner armor for the laptop bag of the invention at least has the following beneficial effects or advantages that:

The anti-collision corner armor for the laptop bag of the invention at least comprises the single-layer corner armor internal body, and preferably, the corner armor internal body is a long strip-shaped protective part and is provided with the protruding parts and the groove part. The upper surfaces of the ends of the corner armor internal body extend outwards to form the protruding parts, the upper surface of the ends of the corner armor internal body extends inwards to form the groove part, and the groove part is located between the two adjacent protruding parts. When a laptop falls and collides with a hard object, the protruding parts on the two sides of the upper surface of the corner armor internal body can deform under the squeezing of the external force and clamp the side edge of the laptop instantly, the friction force between the upper surface of the corner armor internal body and the side edge of the laptop is increased accordingly, and soon afterwards, the middle portion of the upper surface of the corner armor internal body makes contact with the sharp corner of the laptop for buffering. In this way, the anti-collision corner armor is designed for the key protection parts such as the sharp corner (corner) of the laptop, and has high expandability.

The anti-collision corner armor for the laptop bag can further comprise the corner armor external body which is arranged at the corner of the laptop bag, and the upper surface of the corner armor external body is attached to the lower surface of the corner armor internal body. In other words, the anti-collision corner armor for the laptop bag is designed to be of a double-layer structure, the corner armor internal body bends and deforms accordingly when the side edge of the laptop is clamped by the corner armor internal body, and thus the protection effect on the laptop is further enhanced.

Preferably, the corner armor internal body and the corner armor external body are both made of flexible materials, and the hardness of the material made into the corner armor external body is higher than that of the material made into the corner armor internal body. Through the dual-material design, the shaping effect is guaranteed, the protection effect is enhanced, and meanwhile, through the hard material of the corner armor external body, the puncturing risk is avoided in the process.

External design is not adopted by the anti-collision corner armor for the laptop bag of the invention, so that the appearance of the laptop bag is not affected, and the appearance design of the laptop bag is not limited. Moreover, overall protection design is not adopted by the anti-collision corner armor either, so that application fields are more extensive, the design idea is more flexible, and cost control is more excellent.

Figure 1:
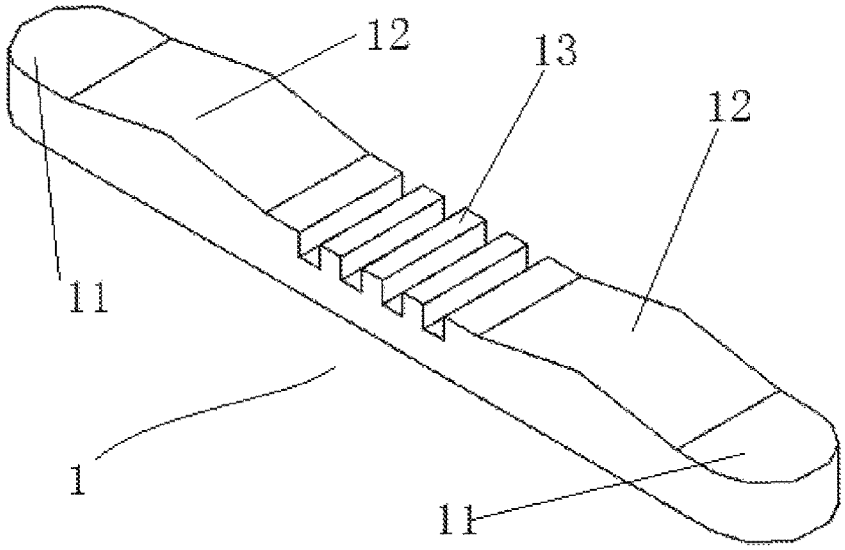
FIG. 1 is a space diagram of an anti-collision corner armor, composed of a corner armor internal body, for a laptop bag in an embodiment.

Description of marks in the drawings: 1, corner armor internal body; 11, flat part; 12, protruding part; 13, groove part; 2, corner armor external body; 21, concave part; 3, corner armor sheet body.

DETAILED DESCRIPTION OF THE INVENTION

For a good understanding of the purposes, technical scheme and effects of the invention, a further detailed description of the invention is given with embodiments.

Figure 2:
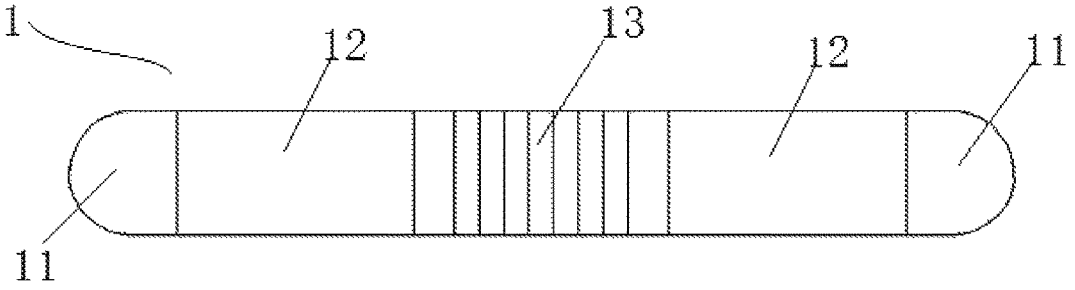
FIG. 2 is a top view of the anti-collision corner armor for the laptop bag shown in FIG. 1.

FIG. 1 shows the anti-collision corner armor for the laptop bag. In the embodiment, the anti-collision corner armor comprises a corner armor internal body 1 which is arranged at a corner of the laptop bag. The corner armor internal body 1 can effectively protect the side edge and the corner of a laptop by discriminatingly designing the surface shape and structure of the corner armor internal body 1. FIG. 2 is the top view of the anti-collision corner armor for the laptop bag shown in FIG. 1. As is shown in FIG. 2 and FIG. 1, the corner armor internal body 1 is preferably designed into a symmetrical long strip-shaped protective part. For conveniently describing the surface shape and structure of the corner armor internal body 1, the corner armor internal body 1 in the embodiment is provided with a corner armor internal body part, and no special treatment is conducted on the upper surface and the lower surface of the corner armor internal body part; the parts which are thicker than the corner armor internal body part are called protruding parts 12; the parts which are as thick as the corner armor internal body part, namely the parts with the thickness the same as that of the corner armor internal body part, are called flat parts 11; the part which is thinner than the corner armor internal body part is called a groove part 13.

The upper surfaces of the ends of the corner armor internal body 1 extend outwards to from the protruding parts 12, the upper surface of the ends of the corner armor internal body 1 extends inwards to form the groove part 13, and the groove part 13 is located between the two adjacent protruding parts 12. As is shown in FIG. 1, the upper surface of the corner armor internal body 1 is provided with two protruding parts 12 and one groove part 13. The portions, not extending outwards, on the two sides of each protruding part 12 form the flat parts 11, each protruding part 12 is connected with two flat parts 11, and the two sides of the groove part 13 are each connected with one flat part Through the design of the groove part 13, bending and deformation of the corner armor internal body 1 are guaranteed, and internal bending and deformation resistance on the corner armor internal body 1 is eliminated. As is shown in FIG. 2 and FIG. 1, the groove part 13 is provided with a plurality of grooves which are arranged at intervals. During actual production, the number of the grooves in the groove part 13 is determined according to the specific application; in the embodiment, the multiple grooves are preferably in parallel without limitation, and are arranged in the width direction of the corner armor internal body 1. In the embodiment, no limit is set to the section shape of the grooves, and a section shape that is easy to realize during the production process is preferred.

As for the material of the corner armor internal body 1, it should be firstly guaranteed that the corner armor internal body 1 can bend and deform under the effect of external force, and the external force can be an interaction force generated when the laptop falls and collides with a hard object or force directly applied to the corner armor internal body 1 from the outside. During actual production, the corner armor internal body 1 is preferably made of a flexible material. The corner armor internal body 1 can bend by 360 degrees and can bend by 90 degrees most commonly. The flexible material of the corner armor internal body 1 can be an EVA plastic raw material (an ethylene-vinyl acetate copolymer) or a TPE thermoplastic elastomer (including a polyolefin elastomer, a polyester elastomer, a polystyrene elastomer and other elastomers).

Asymmetrical design can also be adopted by the corner armor internal body 1 in the embodiment. The groove part 13 is still arranged on the middle portion of the corner armor internal body 1, the protruding part 12 can be only arranged on one side of the upper surface of the end of the corner armor internal body 1, and the other side of the corner armor internal body part of the corner armor internal body 1 can be arranged into a flat part 11. In this way, under the effect of external force, the upper surface of the corner armor internal body 1 can bend towards the laptop, the protruding part 12 acts on the side edge of the laptop, and the groove part 13 makes contact with the corner of the laptop. However, the protection effect of the corner armor internal body 1 adopting the design is obviously inferior to the protection effect of the corner armor internal body 1 adopting the preferred symmetrical design.

In a scenario where the laptop falls and collides with a hard object, the protruding parts 12 on the two sides of the upper surface of the corner armor internal body 1 can deform under the squeezing of the external force and clamp the side edge of the laptop instantly, the friction force between the protruding parts 12 on the upper surface and the side edge of the laptop is increased accordingly, and soon afterwards, the groove part 13 on the middle portion of the upper surface makes contact with the sharp corner of the laptop for buffering, and thus the laptop is effectively protected.

Figure 3:
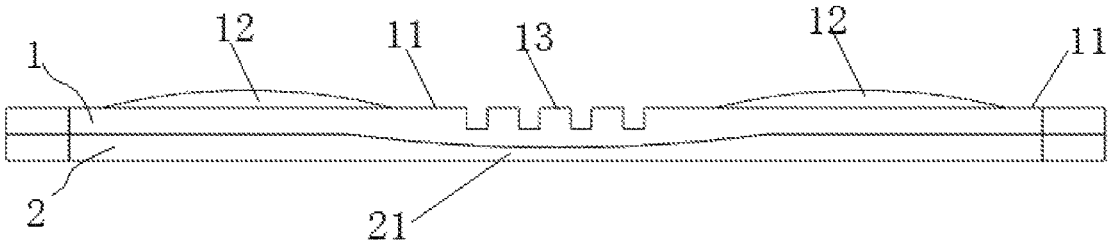
FIG. 3 is a front view of the anti-collision corner armor, composed of the corner armor internal body and a corner armor external body, for the laptop bag in the embodiment.
Figure 4:
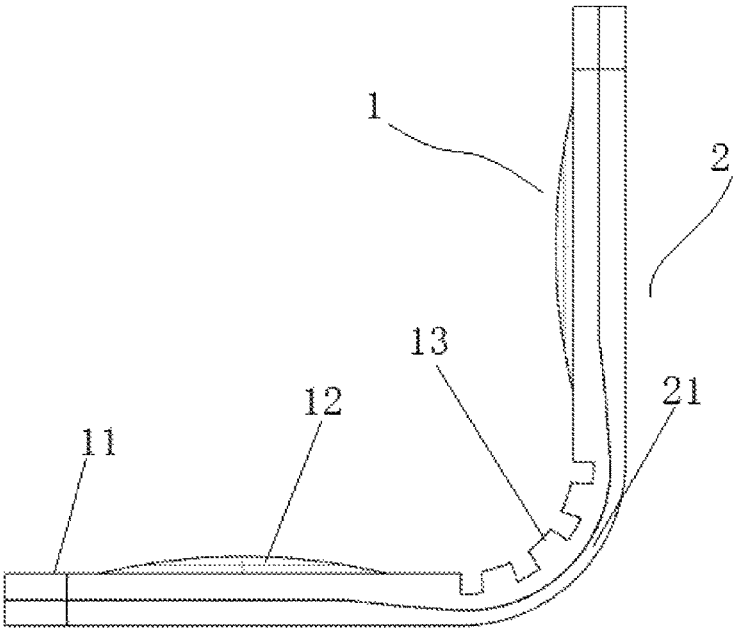
FIG. 4 is a schematic diagram of the anti-collision corner armor, in a bending state, for the laptop bag shown in FIG. 3.

Furthermore, the anti-collision corner armor for the laptop bag in the embodiment can preferably be a double-layer long strip-shaped protective part. A corner armor external body 2 is arranged on the lower surface of the corner armor internal body 1, and as is shown in FIG. 3 and FIG. 4, the upper surface of the corner armor external body 2 is combined with the lower surface of the corner armor internal body 1. The corner armor external body 2 can be integrally and fixedly connected with the corner armor internal body 1 in any mode, such as a bonding mode and a sewing mode.

Under the effect of external force, the corner armor external body 2 and the corner armor internal body 1 bend and deform consistently. The shape and the structure of the corner armor external body 2 can be kept consistent with those of the appearance of the corner armor internal body part of the corner armor internal body 1, namely no treatment is conducted on the upper surface and the lower surface of the corner armor external body 2. As an optimization of the shape and the structure of the corner armor external body 2, the upper surface of the middle portion of the corner armor external body 2 extends inwards to form a bent concave part 21, and under the effect of external force, the bent concave part 21 and the groove part 13 bend and deform synchronously.

As for the material of the corner armor external body 2, it should be firstly guaranteed that the corner armor external body 2 can bend and deform under the effect of external force. The external force can be an interaction force generated when the laptop falls and collides with a hard object, or force directly applied to the corner armor external body 2 from the outside. During actual production, the corner armor external body 2 is preferably made of a flexible material. The corner armor external body 2 can bend by 360 degrees and can bend by 90 degrees most commonly. FIG. 4 shows the condition where the corner armor external body 2 bends by 90 degrees. Preferably, the material hardness of the corner armor external body 2 is higher than that of the corner armor internal body 1, so that the puncturing risk of the corner armor external body 2 under the effect of external force is avoided. Preferably, the corner armor external body 2 is made of a TPU thermoplastic polyurethane elastomer.

Figure 6:
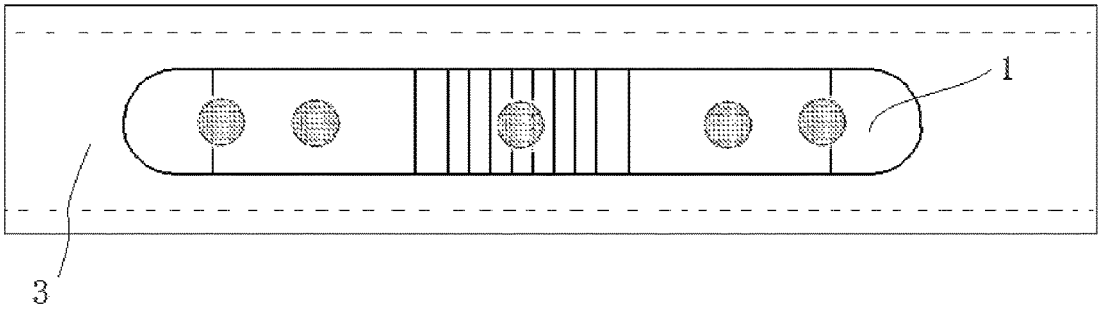
FIG. 6 is a schematic diagram of the mounting position of a corner armor sheet body in the embodiment.

The anti-collision corner armor for the laptop bag in the embodiment further comprises a corner armor sheet body 3. The corner armor internal body 1 can be directly arranged on the corner armor sheet body 3 under the condition that the anti-collision corner armor for the laptop bag is only provided with the corner armor internal body 1. The corner armor external body 2 can be directly arranged on the corner armor sheet body 3 under the condition that the anti-collision corner armor for the laptop bag is provided by both the corner armor internal body 1 and the corner armor external body 2. For better protecting the laptop, the anti-collision corner armor is provided with both the corner armor internal body 1 and the corner armor external body 2. In this way, the corner armor external body 2 and the corner armor sheet body 3 are integrated, and the corner armor internal body 1 is connected with the corner armor sheet body 3 through the corner armor external body 2. The lower surface of the corner armor sheet body 3 is fixedly connected with the laptop bag, and the upper surface of the corner armor sheet body 3 is attached to the lower surface of the corner armor external body 2. FIG. 6 is the schematic diagram of the mounting position of the corner armor sheet body in the embodiment. FIG. 6 is the top view of the anti-collision corner armor for the laptop bag, and since the width and length of the corner armor external body 2 are the same as those of the corner armor internal body 1, the corner armor external body 2 is not shown in FIG. 6. During actual production, the anti-collision corner armor is provided with the corner armor internal body 2 located at the bottom and made of a hard material as well as the corner armor sheet body 3 made of the same material. The corner armor sheet body 3 is integrally connected with the corner armor external body 2 and does not need to be fixed additionally, and the specific size of the corner armor sheet body 3 can be flexibly set according to the application scene of the anti-collision corner armor. The corner armor external body 2 is light, thin and soft, serves as a base of the anti-collision corner armor, and can be easily fixed in the internal structure of the laptop bag in a sewing mode or a bonding mode or a clamping mode or other modes.

Figure 5:
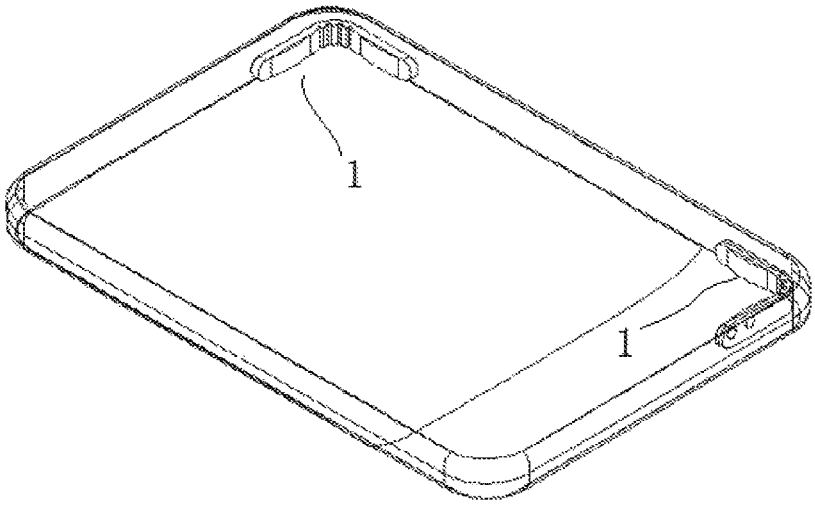
FIG. 5 is a schematic diagram of the mounting position, in the laptop bag, of the anti-collision corner armor for the laptop bag shown in FIG. 3.

FIG. 5 is the schematic diagram of the mounting position, in the laptop bag, of the anti-collision corner armor for the laptop bag. The anti-collision corner armor for the laptop bag is mounted at the corner in the laptop bag, one side of the anti-collision corner armor for the laptop bag is fixed to the length edge in the laptop bag, and the other side of the anti-collision corner armor for the laptop bag is fixed to the width edge in the laptop bag. The curved shape of the anti-collision corner armor for the laptop bag is kept consistent with the shape of the corner in the laptop bag.

The further description of the invention is given above with the embodiments, however, the invention is not limited to the above embodiments, and various changes can be made by common technicians in the field within the available knowledge range without deviating from the intension of the invention.

What is claimed is:

1. An anti-collision corner armor for a laptop bag, at least comprising a corner armor internal body for arranging at a corner of the laptop bag, wherein upper surfaces of the ends of the corner armor internal body extend outwards to form protruding parts, and upper surface of the middle portion of the corner armor internal body extends inwards to form a groove part; under an effect of external force, the upper surface of the corner armor internal body can bend towards a laptop, the protruding parts act on a side edge of the laptop, and the groove part makes contact with the corner of the laptop;

wherein the corner armor internal body is provided with two protruding parts and one groove part, and the groove part is located between the two protruding parts;

the portions, not extending outwards, on two sides of each protruding part form flat parts, each protruding part is connected with two flat parts, and two sides of the groove part are each connected with one flat part;

wherein the anti-collision corner armor further comprises a corner armor external body for arranging at the corner of the laptop bag, and an upper surface of the corner armor external body is attached to a lower surface of the corner armor internal body;

wherein the upper surface of a middle portion of the corner armor external body extends inwards to form a bent concave part, and under an effect of external force, the bent concave part and the groove part bend and deform synchronously.

2. The anti-collision corner armor for the laptop bag according to claim 1, characterized in that the anti-collision corner armor further comprises a corner armor sheet body for arranging at the corner of the laptop bag, the lower surface of the corner armor sheet body is fixedly connected with the laptop bag, and the upper surface of the corner armor sheet body is attached to the lower surface of the corner armor external body.

3. The anti-collision corner armor for the laptop bag according to claim 1, characterized in that the groove part is provided with a plurality of grooves which are arranged at intervals, and the multiple grooves are in parallel.

* * * * *